US007150082B2

(12) United States Patent
Beletsky

(10) Patent No.: US 7,150,082 B2
(45) Date of Patent: Dec. 19, 2006

(54) PLASTIC BELT BUCKLE WITH INTERLOCKING PRONG CATCHES

(75) Inventor: Robert J. Beletsky, Fallbrook, CA (US)

(73) Assignee: Bianchi International, Temecula, CA (US)

( * ) Notice: Subject to any disclaimer, the term of this patent is extended or adjusted under 35 U.S.C. 154(b) by 79 days.

(21) Appl. No.: 10/838,961

(22) Filed: May 4, 2004

(65) Prior Publication Data

US 2004/0226150 A1 Nov. 18, 2004

Related U.S. Application Data

(63) Continuation-in-part of application No. 09/370,388, filed on Aug. 6, 1999, now abandoned.

(51) Int. Cl.
*A44B 11/26* (2006.01)

(52) U.S. Cl. ..... 24/625

(58) Field of Classification Search ..... 24/614–625
See application file for complete search history.

(56) References Cited

U.S. PATENT DOCUMENTS

| | | | |
|---|---|---|---|
| 4,991,272 | A | 2/1991 | Bianchi |
| 5,222,279 | A | 6/1993 | Franco et al. |
| D341,105 | S | 11/1993 | Lovato |
| 5,774,956 | A | 7/1998 | French et al. |

FOREIGN PATENT DOCUMENTS

JP 07275012 A * 10/1995

* cited by examiner

*Primary Examiner*—James R. Brittain
(74) *Attorney, Agent, or Firm*—John E. Wagner

(57) ABSTRACT

A buckle including an auxiliary locking feature includes a female buckle part, including a strap-receiving portion and a body portion defining a recess for receiving a mating portion of a male buckle part and a pair of edge recesses. The male buckle part also has a strap-receiving portion and a pair of flexible female buckle-engaging prongs having catches which snap over mating recesses of female member. The male member also has a resilient cantilevered tongue carrying a release button extending through an opening in the front of the female part, the tongue including integral stop members. The prongs include bosses which engage the stop members. When the prongs are inserted into the recess of the female member, they snap over the mating recesses of the female member and the tongue is pressed downwardly to cause the release button to snap into the opening. With catches engaged, the stops align with the bosses on the prongs preventing the prongs from being depressed to release the buckle until the release button is depressed. Depressing this button moves the stops away from the bosses and allows the prongs to be moved inwardly into the buckle to release the catches. An improved modification of the above-described embodiment includes upwardly and downwardly directed interleavable tapered surfaces on the stops and bosses to prevent simultaneous contact of the release button during inadvertent inward movement of the prongs resulting in release of the buckle.

22 Claims, 14 Drawing Sheets

Section A–A

BUCKLE ASSY SHOWN LOCKED

Section A–A

BUCKLE ASSY BEING RELEASED

Section 6–6

MALE BUCKLE

RELAXED CONDITION

*TYPE OF ACTION*
LINEAR SLIDE LOCKOUT IN THE FEMALE BUCKLE

SECTION A–A

FIG. 23
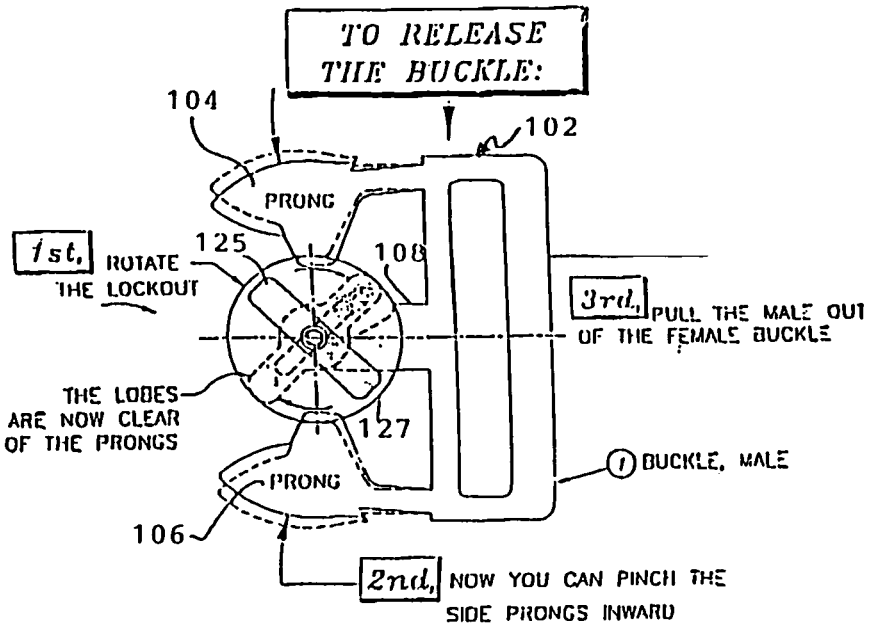
FIG. 24
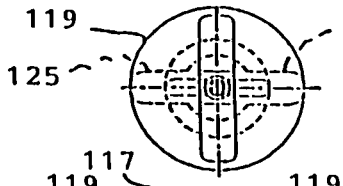
FIG. 25
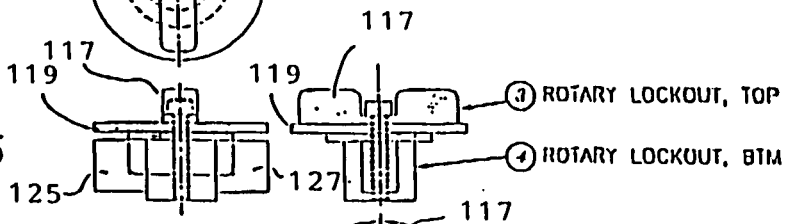
FIG. 26
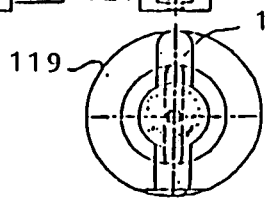
FIG. 27
*TYPE OF ACTION*
ROTARY LOCKOUT IN THE FEMALE BUCKLE FIG. 28
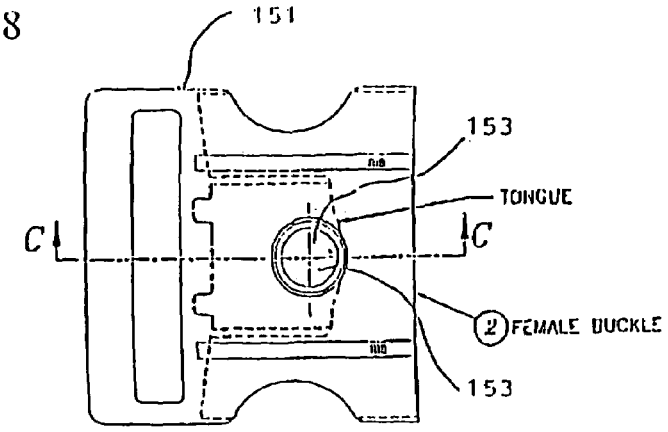
FIG. 29
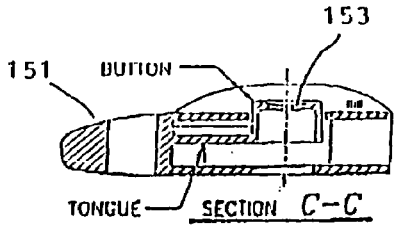
FIG. 30
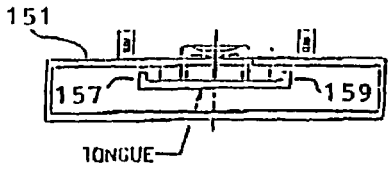
FIG. 31
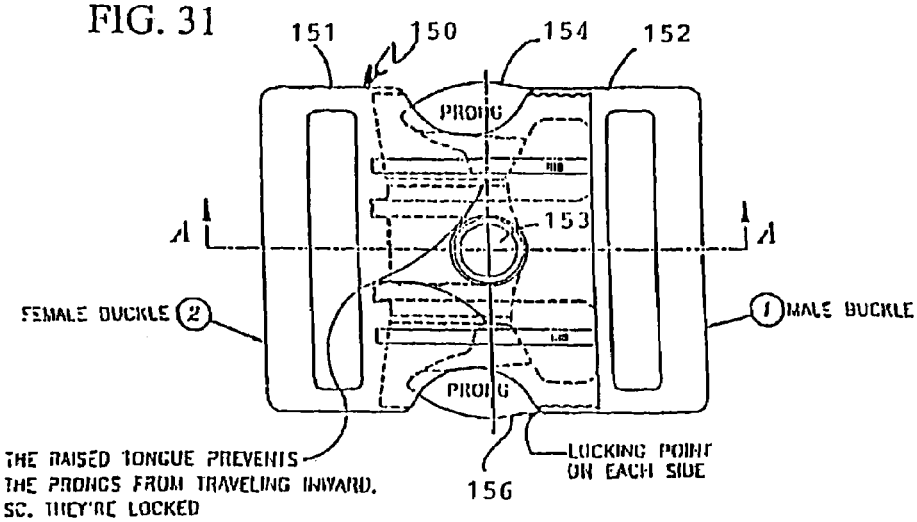
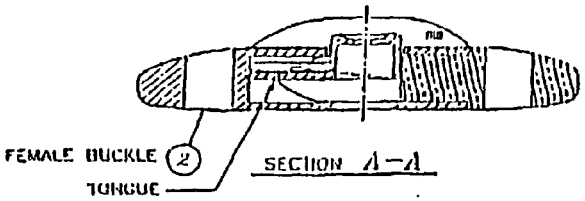
FIG. 32
*BUCKLE ASSY SHOWN LOCKED*

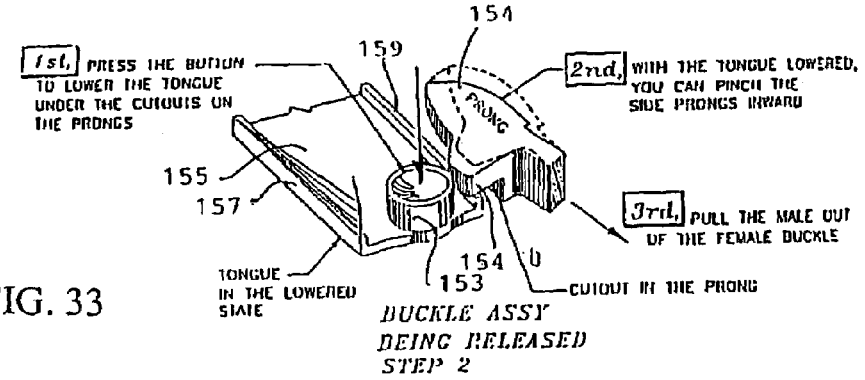
FIG. 33
FIG. 34
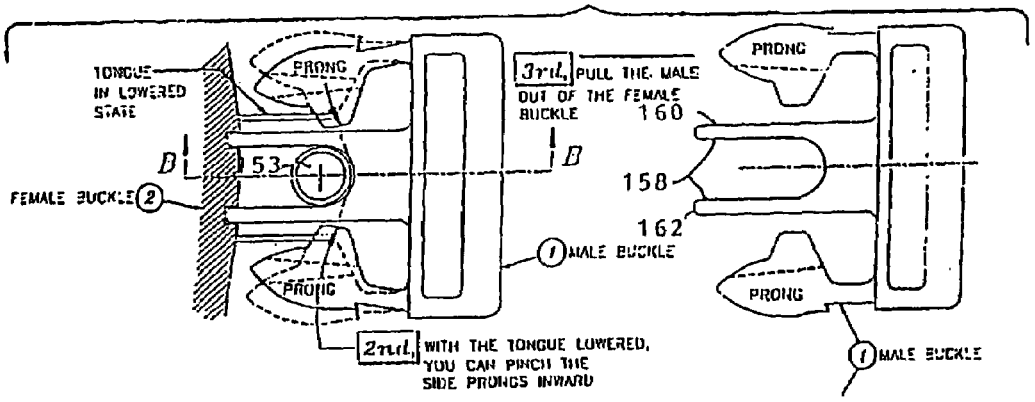
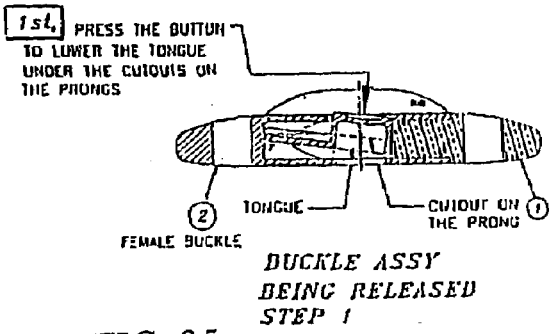
FIG. 35
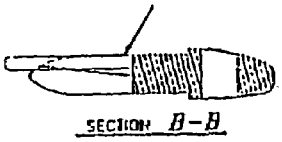
TYPE OF ACTION
VERTICAL ACTION; BUTTON ON THE FEMALE SIDE
FIG. 36

Fig. 38
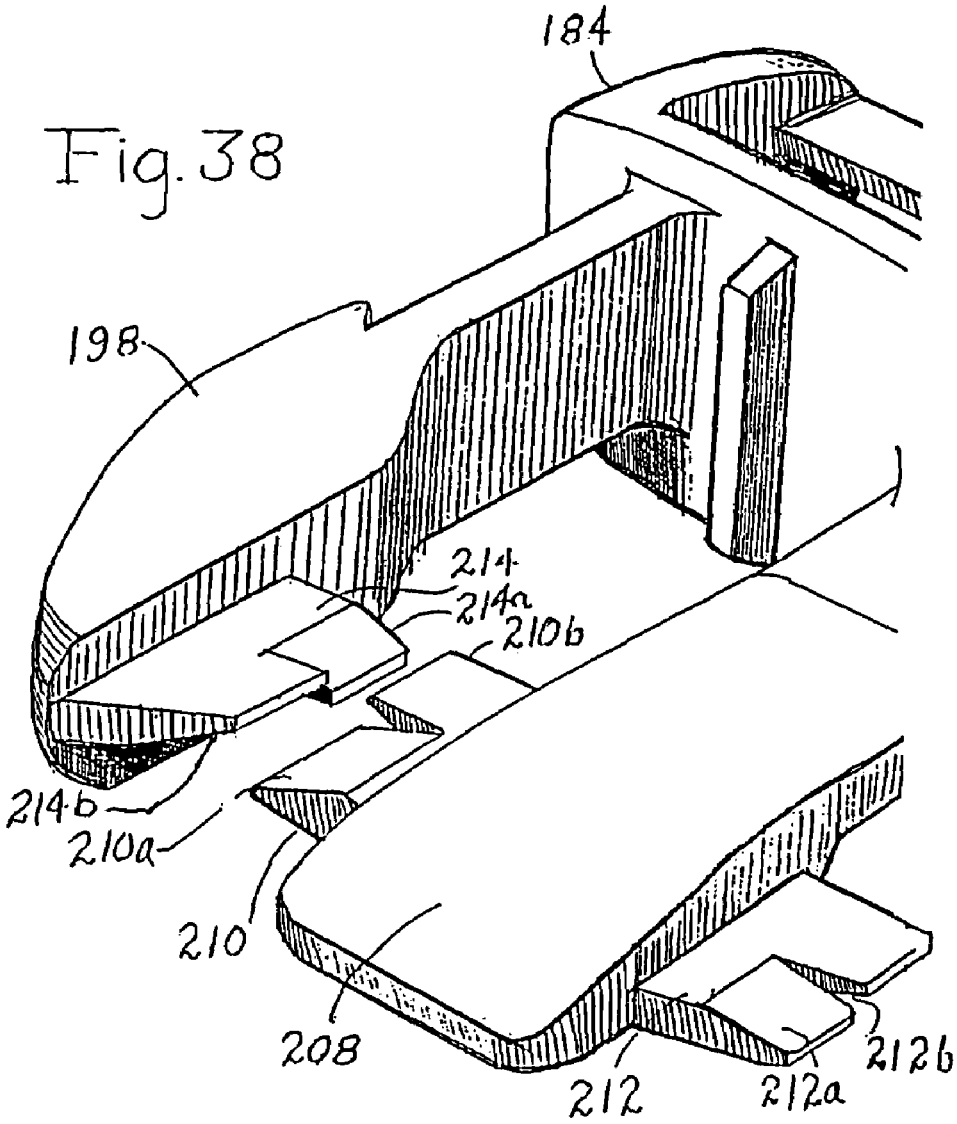
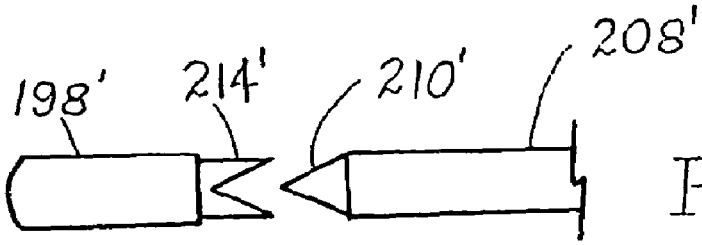
Fig. 39

184
198
214
214c
214a
210b
208
214b
210a
210
206
212
212a
212b

PLASTIC BELT BUCKLE WITH INTERLOCKING PRONG CATCHES

REFERENCE TO RELATED APPLICATION

This application is a continuation-in-part of Ser. No. 09/370,388 filed Aug. 6, 1999 now abandoned, and hereby claims the benefit of the embodiments therein and of the filing date thereof.

BACKGROUND OF THE INVENTION

In recent years, there has been a tremendous advance in the development of effective plastic buckles for use on belts and in joining straps for backpacks and other applications. The buckles are generally rectangular in shape, with a belt or strap loop attachment by at each end. One part is identified as the receptor or female part, and the other the male or engaging part, and the loop attachments are cross bars on the outer ends of each of the male or female part. The two parts interlock and typically the receiving part has an attractive front surface which may be ornamented in many respects or left plain.

In these buckles, the engaging part normally includes a pair of locking prongs at the top and bottom, and a tongue or tang in the center to guide the mating of the two parts when buckling the device. The tongue or tang is inserted into the receptor part and the prongs are flexible and have integral catches which extend upward and downward in relationship to the face of the buckle. The buckle receiver typically has openings top and bottom where the prongs may be contacted and with the first finger and thumb to be squeezed together simultaneously to release the top and bottom catch allowing the buckle to slide open. Often guide rails are contained within the receiver body and similar rails or grooves are present on the tang to ensure that the two parts engage in a smooth, straight, sliding movement. This class of buckle is the subject of the John Bianchi U.S. Pat. No. 4,991,272 assigned to the assignee of this application and U.S. Pat. No. 5,222,279, as well as U.S. Design Pat. No. D341,105.

The combination of the two prongs with catches and guiderails gives a degree of protection from the buckle becoming only partly engaged and inadvertently released.

Others have thought to add some further protection from unintended release, such as a button that must be released, in addition to the intended release of the two prong catches. Such a secondary button has appeared on the front face of the receiver and acts as a third catch. Such a latch is illustrated by U.S. Pat. No. 5,774,956. In that system, the button must be actuated simultaneously with the two edge prongs.

Simultaneous operation does not appear to be desirable and instead it would appear preferable that the actuating button should act as an overriding lock of the top and bottom prongs preventing their release through mechanical interaction between the front button and each of the top and bottom prongs.

BRIEF SUMMARY OF THE INVENTION

Faced with this state of the art, it appeared that an independent button-controlled lock might add an additional degree of security, but in actuality, it is a modest addition to the buckle. It has been very clear that one can unintentionally release one of the prong catches merely by a downward pressure on the top prong catch or by an upward pressure on the bottom prong catch. Since these are often not readily visible, it is possible for one of the catches to be released, and then the second one released, and then the total integrity of the buckle rests solely on any button and its third catch. For the most effective buckle, one does not want three independent catches, any one of which can be released independently of the others.

From the foregoing, it was determined that the most effective use of the third button is one that does not have a catch but blocks release of either top or bottom prong until it is actuated. It automatically releases both the top and bottom prongs so that neither the top nor the bottom prong catches can be disengaged without first releasing the third catch. In such a case, the thumb and index finger are used to release the top and bottom prong catches as in the past. Another finger is used to operate the button and allow the top and bottom prongs to move. This allows both the top and bottom prong catches to be released by thumb and finger pressure. Therefore, the three interconnected release devices are effective to maintain the buckle engagement at all times when engagement is intended.

Described herein are several embodiments of this invention namely:

1) a resiliently mounted front button embodiment with a button that is depressed inwardly to allow flexing movement of the top and bottom prongs for their release;

2) a sliding front catch optionally protected by side ribs and likewise must be first operated to allow inward flexing of the top and bottom prongs;

3) a rotating front latch similarly protected and similarly operative;

4) a front button embodiment where the front button is formed integrally in the female buckle part and thereby always protected within the buckle body; and 5) a resiliently mounted front button version, including a centrally positioned tongue which is depressed inwardly to allow flexing movement of the top and bottom prongs for their release, including interfitting surfaces on one of the prongs and the tongue, which is overlapped by other interfitting surfaces on the other of said prongs and tongue thereby providing a further structure to prevent unlocking the buckle without first depressing the tongue. The preferred embodiment of this version 5) includes mating interfitting surfaces on the tongue and top and bottom prongs which must not interfit for the prongs to release. Interfitting prevents unintended release when engagement of the prongs takes place. The beveled tips of the tongue must drop below the interfitting plane, in order to depress enough to allow the male to leave the female half of the buckle.

These various embodiments each have preferred applications.

BRIEF DESCRIPTION OF THE DRAWINGS

This invention may be more clearly understood with the following detailed description and by reference to the drawings in which:

FIG. 23 is a front elevational view of the male member of the second alternate embodiment of this invention with the prongs shown in dashed lines to represent their locked condition;

FIG. 24 is a top plan view of the lockout mechanism of the embodiment of FIGS. 20–23;

FIG. 25 is a side elevational view of the lockout mechanism of FIGS. 20–24;

FIG. 26 is a side elevational view of the lockout mechanism of FIGS. 20–25;

FIG. 27 is a top plan view of the lockout mechanism of FIGS. 20–26;

FIG. 28 is a front elevational view of the female member of a third alternate embodiment of this invention;

FIG. 29 is a longitudinal sectional view of the female member of this third alternate embodiment of FIG. 28 taken along lines C—C of FIG. 28;

FIG. 30 is a side elevational view of the female member of FIG. 28;

FIG. 31 is a front elevational view of an assembled third alternate embodiment;

FIG. 32 is a longitudinal sectional view of the buckle of FIG. 31 in a locked condition with this section taken along lines A—A of FIG. 31;

FIG. 33 is a fragmentary perspective view of the buckle of FIG. 31 in the step of being released by finger pressure on the female part button in the direction of the arrow in FIG. 33;

FIG. 34 is an exploded view of the male member of the third alternate embodiment of FIG. 31 showing the unlocked condition with prongs depressed in solid lines and in dashed lines in their locked condition and with the unrestrained male member shown to the right;

FIG. 35 is a longitudinal sectional view of the buckle assembly of FIG. 34 taken along lines B—B of FIG. 34;

FIG. 36 is a longitudinal sectional view of the male member of FIG. 34;

FIG. 38 is a fragmentary perspective view of the male member of FIG. 37 showing the bifurcated locking surfaces;

FIG. 39 is a fragmentary side elevational view of an alternate form of interlocking surfaces including a groove and pointed blade configuration.

DETAILED DESCRIPTION OF THE INVENTION

Figure 1:
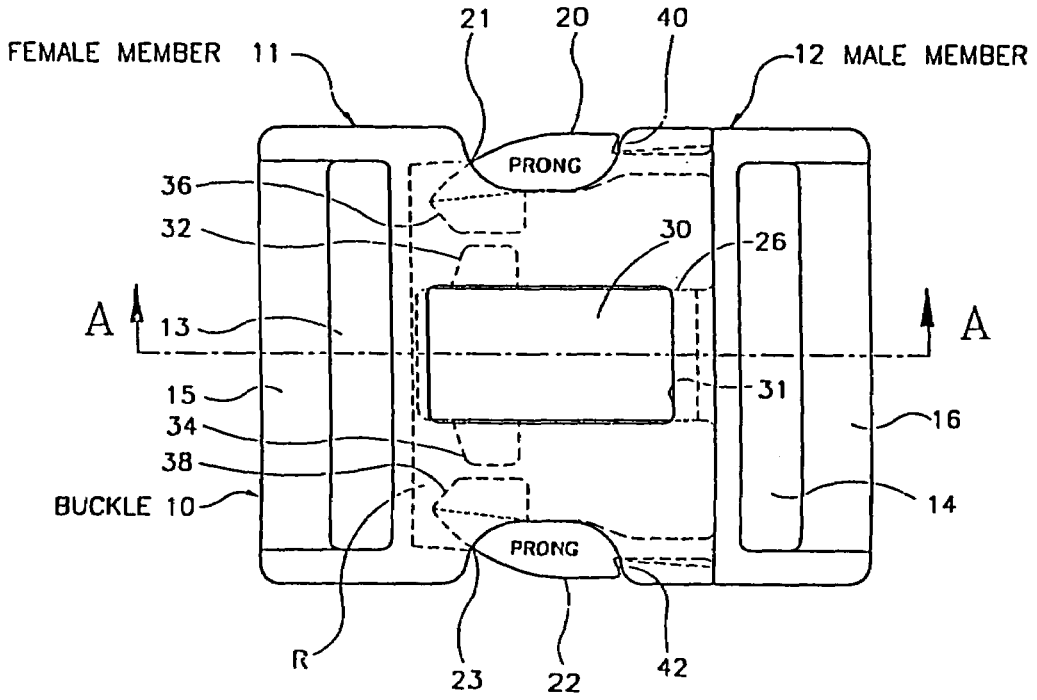
FIG. 1 is a front elevational view of a buckle of this invention.

Referring now to FIGS. 1 through 6 of the drawing, a buckle generally designated 10 comprises a partially hollow female member 11 and a male member 12 in assembled condition with respective belt loops 13 and 14 defined by cross bars 15 and 16, respectively. The female and male parts 11 and 12 are shown locked with the female part having recesses 21 and 23 in the upper and lower edges, respectively. The male part 12, with upper and lower flexible prongs 20 and 22, extends through the openings defined by recesses 21 and 23 of the female member 11, and in locking engagement with catches 40 and 42.

Figure 2:
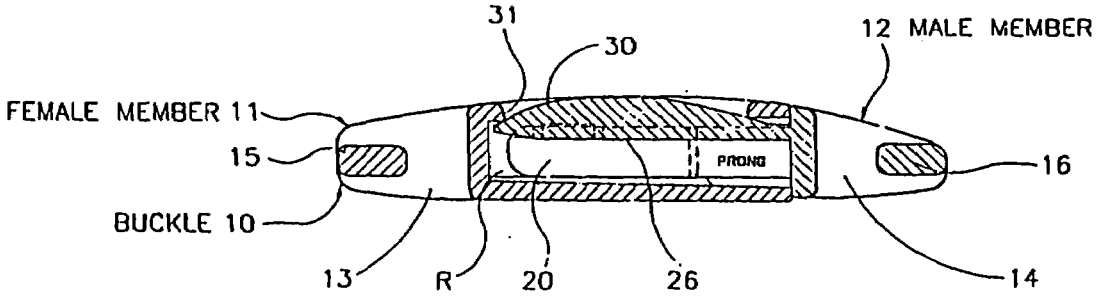
FIG. 2 is a transverse sectional view of the buckle of FIG. 1 taken along line A—A of FIG. 1.

As may be seen in FIGS. 1 and 2, the female member 11 has a generally rectangular recess for receiving the male member 12. The male member 12 has a three-part extension including the two prongs 20 and 22 and a resilient cantilevered tongue 26 carrying a release button 30 and integral stop members 32 and 34. The release button 30 extends through the front of the female member through an opening 31. Note that the prongs 20 and 22 each include a respective bosses 36 and 38 of which engage the stops 32 and 34 integral with the release button 30 and the cantilevered tongue 26, of the male part 12.

Note in FIG. 2 that the button 30 is preferably sloped on its upper face and is not in locking engagement with the female part and does not include any mating catch. In accordance with this invention, whenever the buckle is engaged, the male member 12, including prongs 20 and 22 is inserted into the receptacle R of female member 11 until catches 40 and 42 snap over the mating recess edges of female member 11.

At the same time, tongue 26 is depressed downwardly or behind the front face of member 11 until it reaches opening 31, when button 30 snaps into opening 31. When catches 40 and 42 are thus engaged, the stops 32 and 34 engage bosses 36 and 38 on the male member, and the prongs 20 and 22 cannot be depressed to release the buckle until the button 30 is depressed. The depression must be sufficient to move the button 30 and its stops 32 and 34 away from the integral bosses 36 and 38. This will allow the prongs 20 and 22 to move inwardly into the buckle, namely, downward in FIG. 1 for prong 20 and upward in the same figure for prong 22 thereby releasing catches 40 and 42.

This action can easily be accomplished by grasping prongs 20 and 22 with the right-hand thumb and a finger and simultaneously applying pressure with the forefinger to depress button 30. The same, of course, can be accomplished using the left hand. The button 30 and its stops 32 through 34 cooperate to positively lock prongs 20 and 22 against inward depression.

Figure 3:
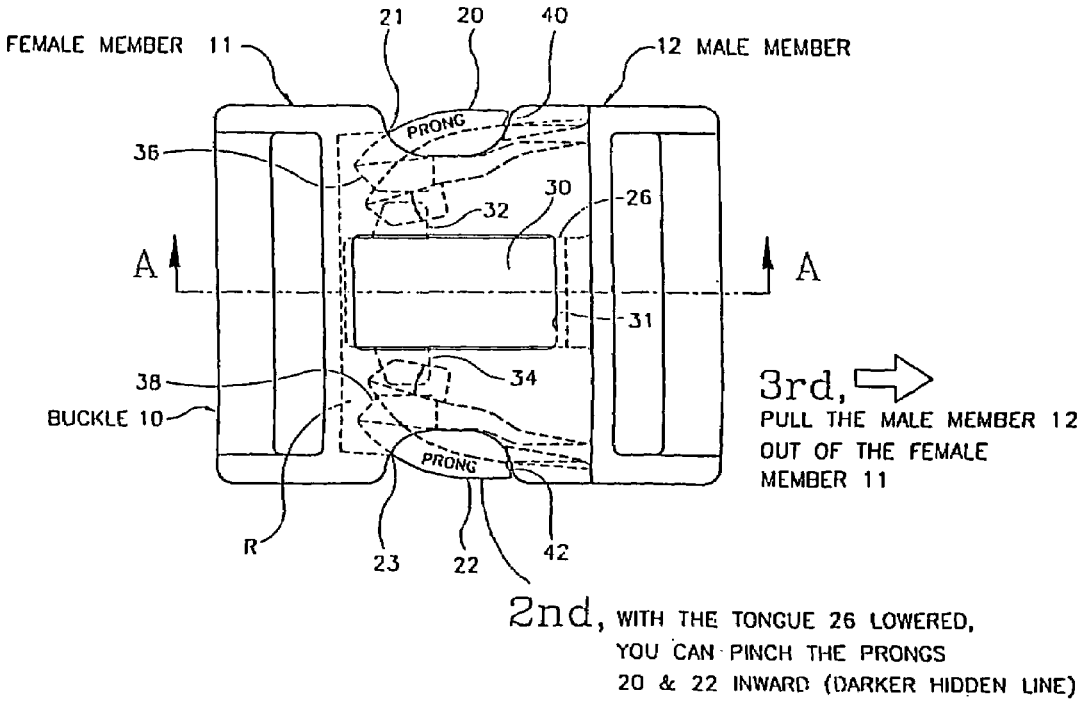
FIG. 3 is a front elevational view of a slightly modified form of the buckle of FIG. 1 with the prongs shown in dashed lines to indicate the prong positions during the step of opening the buckle.
Figure 4:
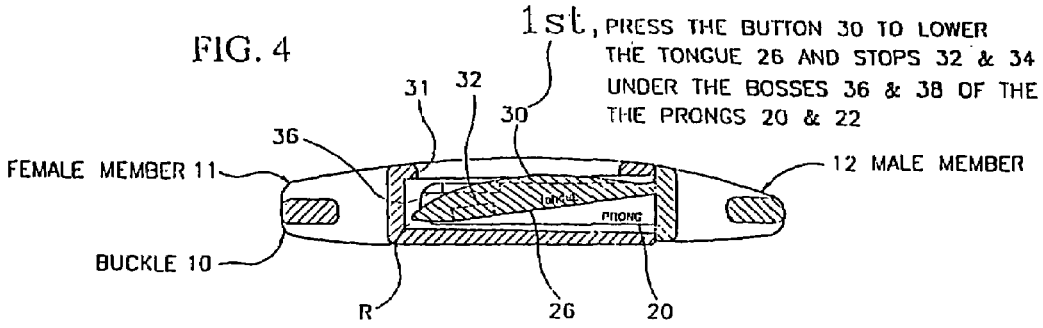
FIG. 4 is a transverse sectional view similar to FIG. 2 with the buckle in the act of being released.

Please refer now specifically to FIGS. 3 and 4 which show a slightly modified form of buckle. The button 30 is depressed and prongs 20 and 22 shown in dashed lines are squeezed to release the catches 40 and 42. This can be accomplished only when the stops 32 and 34 have moved below the level of the bosses 36 and 38. Deflection of the bosses 32 through 34 is possible due to the resilience of the tongue 26. As soon as finger pressure is released from the button 30 and the prongs 20 and 22 have moved out of the way, the button 30 and its stops 32 and 34 again resume a locking position in contact or immediately adjacent to the bosses 36 and 38 as shown in FIG. 5.

Figure 5:
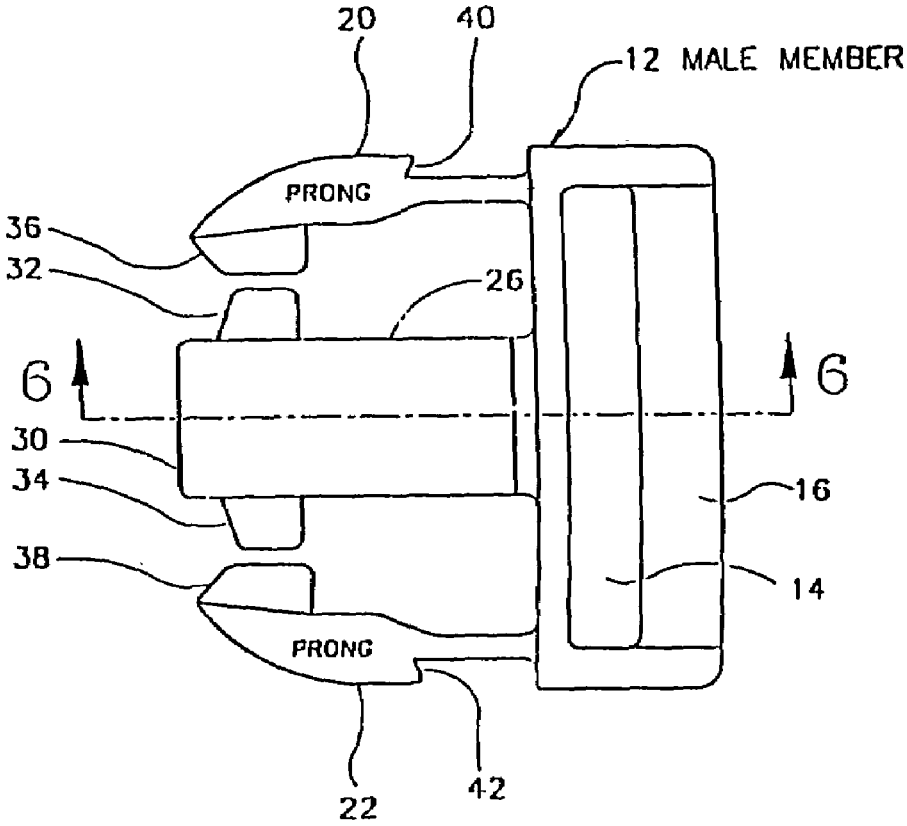
FIG. 5 is a front elevational view of the male buckle member of the embodiment of FIG. 1.
Figure 6:
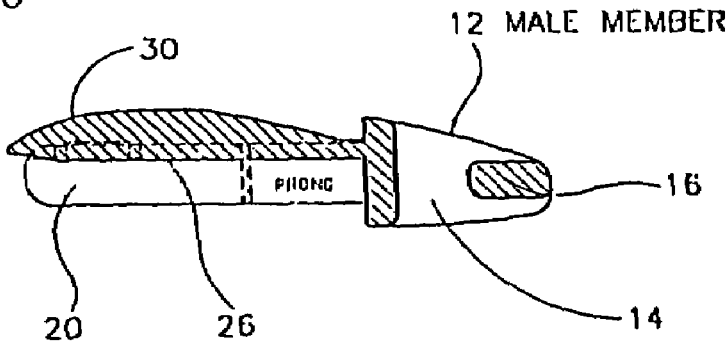
FIG. 6 is a longitudinal sectional view of the male member of FIG. 5 taken along line 6—6 of FIG. 5.

FIG. 6 is a cross sectional view taken along line 6—6 of FIG. 5 and shows the configuration of the male buckle member 12 as separated from female member 11.

In the normal and restrained position of the tongue 26 and prongs 20 and 22 as shown in FIGS. 1 and 3, there is little likelihood of the prongs 20 and 22 of the male member 12 catching and being distorted and possibly broken. Therefore, the feature of this invention that provides locking of the buckle when engaged also provides an additional second function of protecting the male member from damage by the female member.

The First Alternate Embodiment

Although the use of the button 30 of the first embodiment is desirable and a preferred embodiment of this invention, it is recognized that another means for locking the male member's prongs from inadvertent release in this type of buckle, is possible. Such an arrangement, including a sliding lock, may also be employed. Such an embodiment is disclosed in FIGS. 7 through 17.

Figure 7:
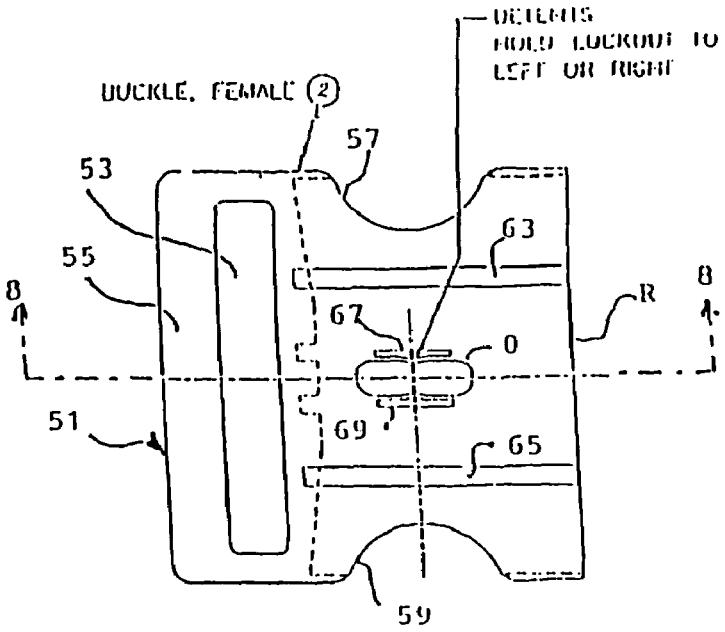
FIG. 7 is a front elevational view of the female part of a first alternate embodiment of this invention.
Figure 8:
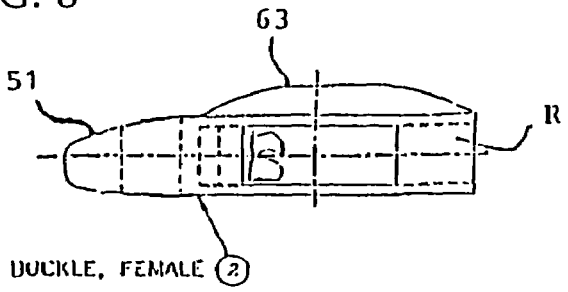
FIG. 8 is a longitudinal sectional view taken along line 8—8 of FIG. 7.
Figure 9:
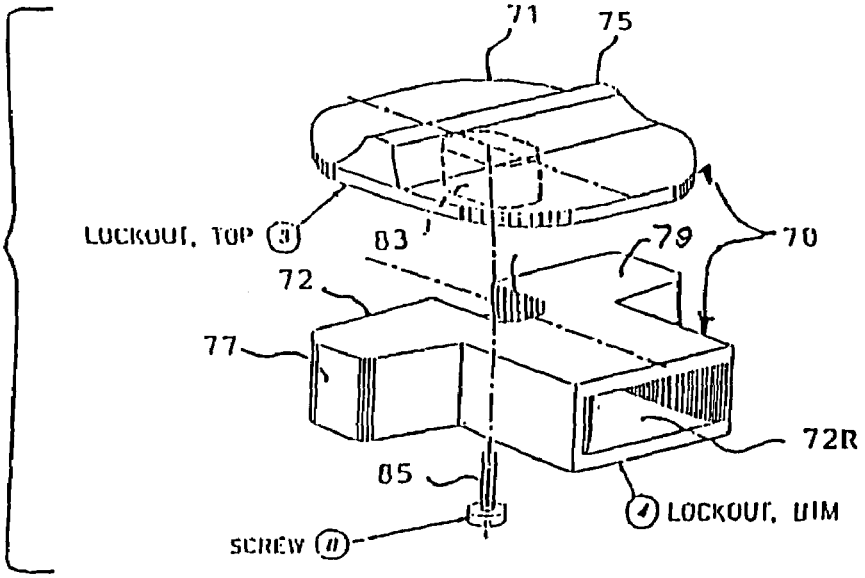
FIG. 9 is in exploded perspective view of the lockout assembly of this first alternate embodiment.
Figure 10:
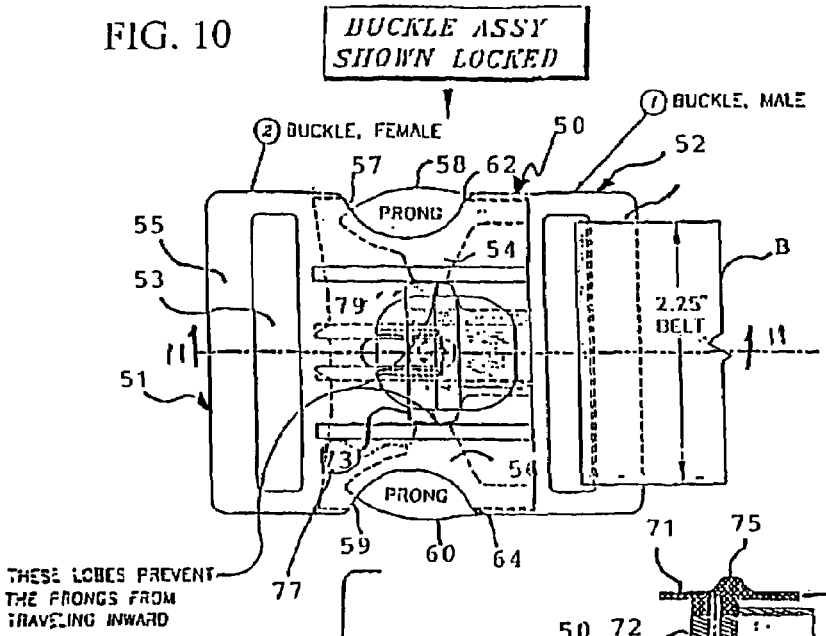
FIG. 10 is a front elevational view of the buckle of a first alternate embodiment shown with a portion of a belt shown secured to the male member of the buckle.
Figure 11:
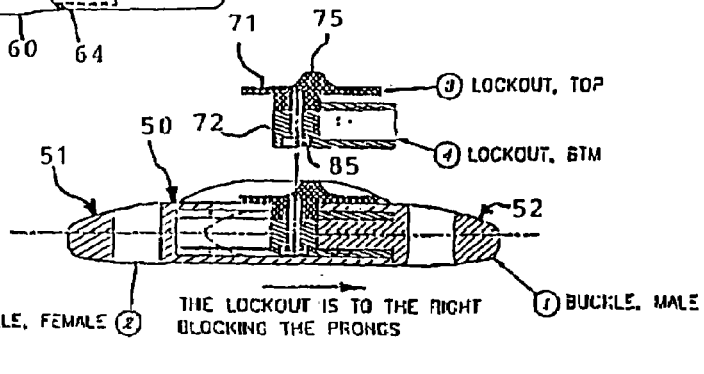
FIG. 11 is a longitudinal sectional view of this first alternate embodiment taken along lines 11—11 of FIG. 10 showing the lockout assemblies both in place in the buckle and a similar assembly shown above the buckle.
Figure 12:
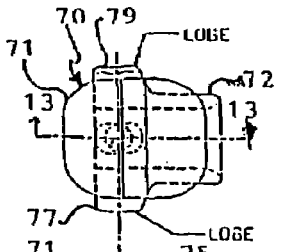
FIG. 12 is a front elevational view of the lockout assembly of FIGS. 10 and 11.
Figure 13:
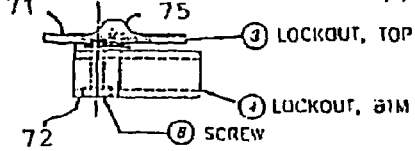
FIG. 13 is a longitudinal sectional view of the lockout assembly of FIG. 12 taken along lines 13—13 of FIG. 12.
Figure 14:
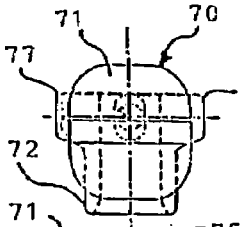
FIG. 14 is a front elevational view of the lockout assembly of FIG. 12 oriented at 90 degrees, as compared with FIG. 12.
Figure 15:
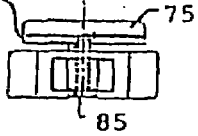
FIG. 15 is a side elevational view of the lockout assembly of FIG. 14.

Now referring to FIGS. 7 through 9, the alternate form of female member 51 may be seen with a belt loop 53 defined by a cross bar 55. The female member includes a generally rectangular recess R, best seen in FIG. 8, and a pair of edge openings 57 and 59, similar to recesses 21 and 23 of the embodiment of FIGS. 1 through 6 for engaging prongs of the male part which is illustrated in FIGS. 10 and 11.

The female part 51 includes a pair of longitudinally extending ribs 63 and 65, one on each side of an elongated opening O in the front face of the female part 51 and communicating with the internal recess R. Immediately adjacent to the sides of the opening O are a pair of detent members 67 and 69 which are used to provide an indication of transition from locked to unlocked position and to prevent unintended unlocking of the locking device of this embodiment. This feature is best understood in connection with the explanation, below of FIG. 10.

The locking member of this embodiment, namely the lockout assembly 70, is best seen in FIG. 9. This assembly 70 includes a top member, including a transversely extending bar 75 for finger operation, and also includes an elongated boss 83 shown in phantom in FIG. 9. The lockout top 71 rests over the front face of the female part 51 and is secured to the lockout bottom 72 which is a generally T-shaped member located within the recess R of FIG. 7. The lockout parts top 71 and bottom 72 are secured together by a fastener such as screw 85 with the elongated boss 83 resting in a U-shaped groove 81 in the lockout bottom 72. The lockout assembly is able to move longitudinally with respect to the female part 51 by finger pressure on the transversely extending bar 75.

Key to the operation of this embodiment is the fact that the lockout bottom member 72 includes a pair of lobes 77 and 79 which extend laterally with respect to the direction of movement of the lockout assembly 70. The lobes 77 and 79 therefore move from a prong locking position to secure the male buckle member 52 of FIG. 10 to the female member 51 in one position and to a prong unlocking position to allow the prongs of the male member 52 to be released. This is best understood in connection with FIGS. 10 and 11.

Figure 16:
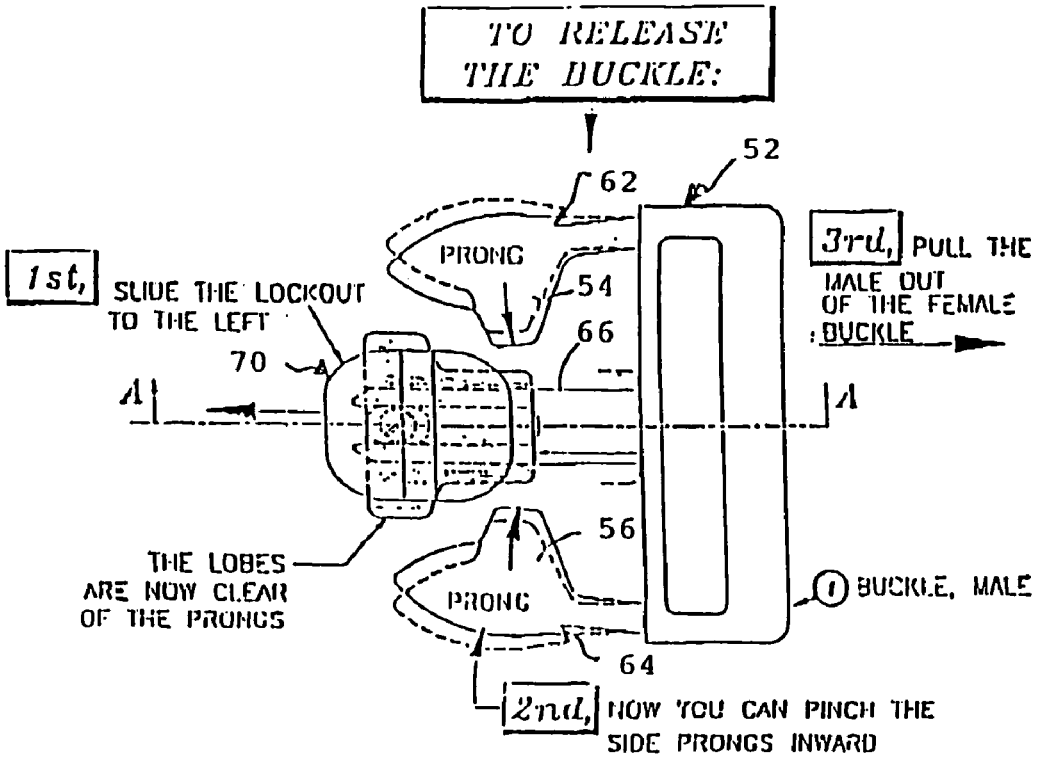
FIG. 16 is a front elevational view of the male member of the buckle of FIG. 10 with the lockout assembly in one position and the prongs of the male member shown in dashed lines in their locked condition.
Figure 17:
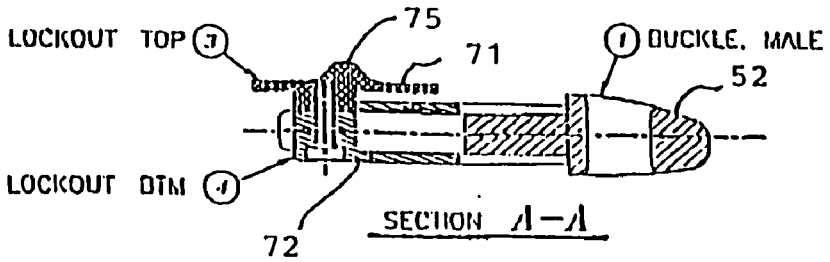
FIG. 17 is a longitudinal sectional view of the male member of the first alternate embodiment of FIG. 16 taken along line A—A of FIG. 16.

Also characteristic of the lockout assembly 70 is the fact that the leg of the T-shaped bottom member 72 includes an elongated generally rectangular recess 72R that receives a tongue 66 of the male member 50 of FIG. 16, similar to the tongue 26 of the first embodiment. The tongue 66 and the bottom lockout member 72 insure linear engagement of the male and female parts 50 and 51 during the buckling operation.

Now referring to FIGS. 10 through 17, the full buckle 50, 51 is shown in locked condition with a belt segment B secured in the normal manner to the male part 52 by encircling its cross bar. Prongs 58 and 60 are visible extending out of respective recesses 57 and 59. The lobes 77 and 79 of the lockout assembly 70, best seen in FIG. 10, engage bosses 54 and 56, respectively of the prongs 58 and 60. In this condition, the prongs 58 and 60 may not be depressed since each bear against opposite sides of a rigid member, namely, the lobes 77 and 79 of the T-shaped lower lockout member 72. This section of the lower lockout member 72 is rigid and reinforced by the tongue 66 as may be seen in FIG. 11 in phantom, and in FIG. 16, which shows the male part 50 in its relationship to the lockout assembly 70.

Suffice it to say, particularly by reference to FIGS. 10 and 16, the lockout assembly 70 is operative to allow the prongs 58 and 60 to be depressed when in the most forward position as is shown in FIG. 16 and effectively prevents the compression of the prongs 58 and 60 and release of their integral catch when the lockout assembly is in the retracted position as shown in FIG. 10. The presence of the ribs 63 and 65 of FIG. 7 protect the lockout assembly 70 from most contact which might cause its movement from locked to unlocked position.

The ribs 63 and 65 also act to direct the user's finger in the line of locking or unlocking movements. This aids the user since only tactile reference is needed to operate the lockout assembly 70. The detents 67 and 69 of FIG. 7 provide a tactile indication of movement to an unlocked or locked position. When moved to an unlocked position, the release of the buckle 50 still requires simultaneous or near simultaneous compression of the prongs 58 and 60. A simple forward sliding motion of the hand allows release of the lockout assembly 70 by the forefinger and compression of the prongs 58 and 60 by the thumb and a finger for quick release of the buckle in one natural motion.

Second Alternate Embodiment

In further refinement of this invention, I determined that another positive locking arrangement can be achieved by using a rotary locking assembly that also serves to prevent the depression of the prongs of an edge squeeze to release type of buckle. Such an embodiment is illustrated in FIGS. 18 through 27.

Figure 18:
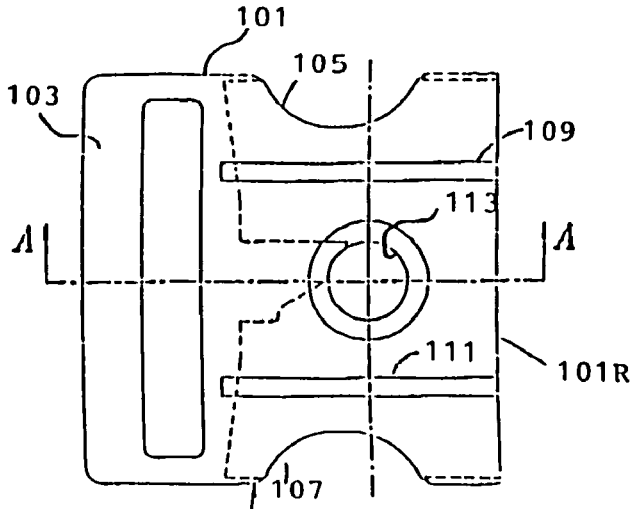
FIG. 18 is a front elevational view of the female member of a second alternate embodiment of this invention.
Figure 19:
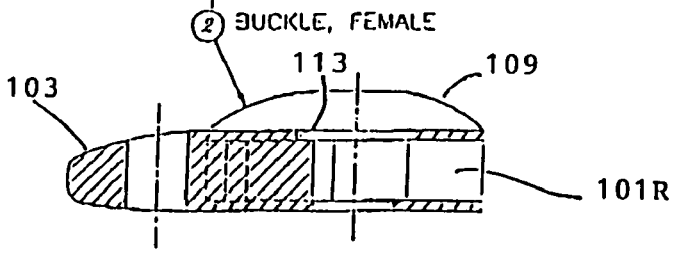
FIG. 19 is a longitudinal sectional view of the female member of the second alternate embodiment taken along line A—A of FIG. 18.
Figure 20:
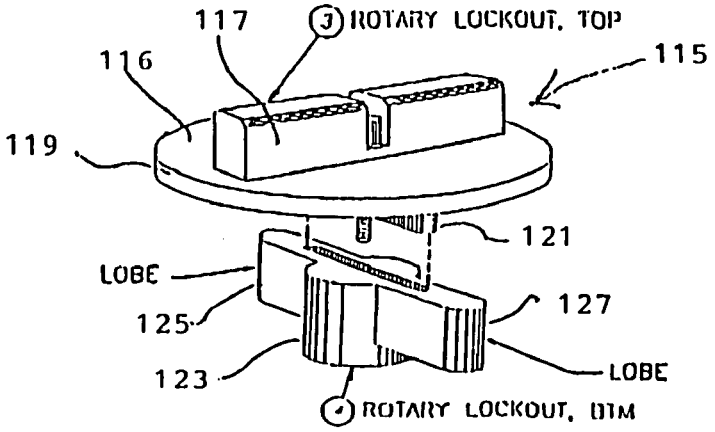
FIG. 20 is an exploded perspective view of the lockout assembly of this second alternate embodiment of this invention.
Figure 21:
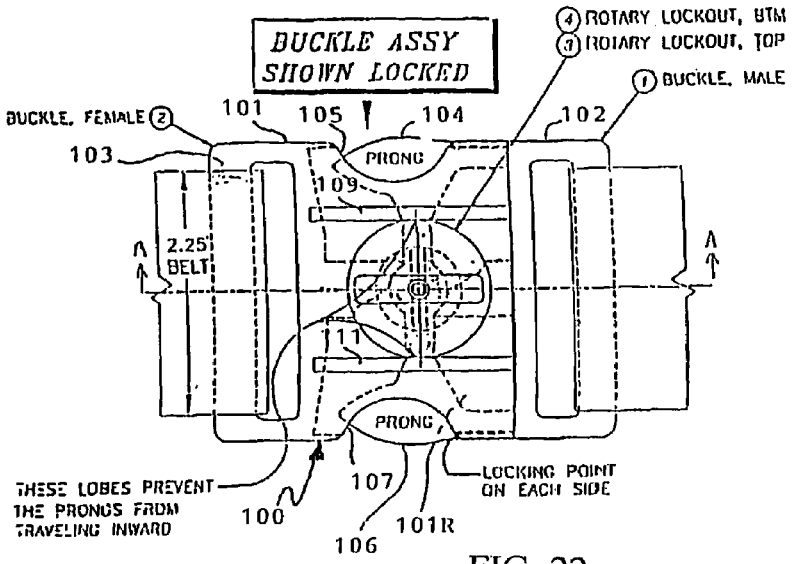
FIG. 21 is a front elevational view of the second alternate embodiment of this invention shown in assembled lock condition with fragmentary belts shown attached to the male and female members of the buckle.
Figure 22:
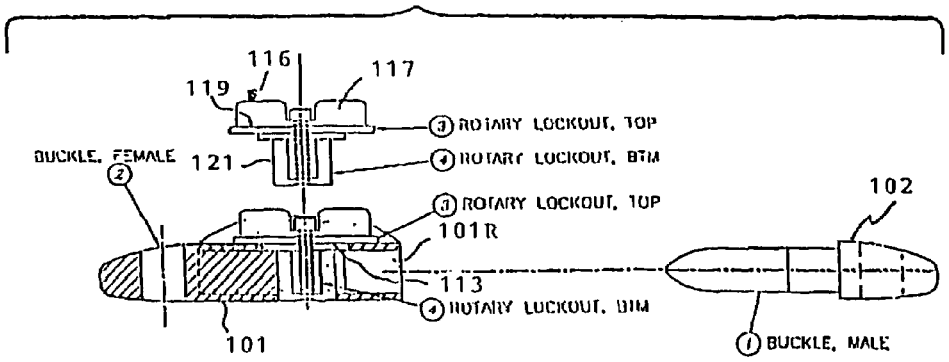
FIG. 22 is exploded view of the buckle of the second alternate embodiment with the female member shown in a longitudinal section along line A—A of FIG. 21 with the lockout assembly shown both attached to female member and duplicated above the female member and the male member in side elevational view.

Now referring to FIGS. 18 through 23 which show the female member 101 in FIG. 18, the latched buckle, generally designated 100, in FIG. 21, and the male member 102 in FIGS. 22 and 23. The female member 101 includes a belt loop defined by a cross bar 103, a pair of edge recesses 105 and 107, and a generally rectangular recess 101R. Female member 101 likewise includes a pair of ribs 109 and 111 and a circular opening 113 of FIGS. 18 and 22. The opening 113 receives a rotary lockout assembly, generally designated 115 of FIG. 20.

The rotary lockout assembly 115 includes a top lockout member 116 with an integral crossbar 117 that is used to rotate the lockout assembly 115 from a locked to an unlocked position by the user. The top lockout member 116 includes a disc portion 119 resting on top of the front face of the female member 101 between the ribs 109 and 111. A spline 121 extends from the lower face of the disc portion 119 through the circular opening 113 in female port 101 and engages a lower or bottom rotary lockout member 123 carrying a pair of lobes 125 and 127. These lobes 125 and 127 are dimensioned so that they will bear against the prongs 104 and 106 of the male member 102 when in a locked orientation. When the rotary lockout member 115 is rotated away from the locked orientation, allows the prongs 104 and 105 of the male member 102 to be pressed inwardly and unlatch.

FIG. 21 shows the latched and locked buckle 100. A 90-degree rotation in either direction places the buckle 100 in an unlocked condition ready for unlatching by pressure on the prongs 104 and 106 of the male member 102. It is also clear that less than 90-degree rotation will allow the buckle to be released by pinching the prongs 104 and 106 simultaneously and drawing the male and female parts 102 and 101 apart.

The rotary lockout assembly 115 can be located on either the male part 102 or on the female part 101. If located on the male part 102 as shown in FIG. 23, the opening 113 of the female part is a slot rather than a round opening. If located on the female part 101, the round opening is used and the male part of FIG. 23 only includes its tongue 108 and lacks the rotary lockout assembly 123. In either case, the rotary lockout assembly 123 prevents the release of the buckle by blocking the inward depression of the prongs 104 and 106 in one orientation and allows their release when the rotary lockout assembly is at any orientation other than with the lobes 125 and 127 engaging or interfering with the depression of prongs 104 and 106.

This embodiment provides protection from any force on the front of the buckle 100 causing the release of the rotary lockout assembly. An intended rotary movement, usually requiring a thumb and a finger to rotate the assembly 123, is necessary.

Third Alternate Embodiment

During the development of this invention, it appeared that it is also possible to make a locking buckle employing a button release on the female member, utilizing a cantilevered tongue carrying the release button to engage and release the prongs rather than through the presence of lobes. The release button can be molded integrally with the female part. This embodiment is illustrated in FIGS. 28 through 36. Fundamental to this embodiment is the fact that the cantilevered carrier of the button engages the prongs of the male part whenever the button is not depressed.

Refer now to FIGS. 28 through 36, with particular reference to FIG. 28 showing the female part 151, FIG. 31 showing the latched and locked buckle 150, FIG. 33 showing the process of releasing a prong, and FIG. 34 showing the male member 152.

The female member 151 presents the same general appearance as the previously disclosed female members except that the release button 153 remains a part of the female member 151 at all times and, in fact is integrally molded into the female part. The male part 152 of FIG. 34 includes a pair of prongs 154 and 156 and a central forked tongue 158. The tongue 158 aligns the male and female buckle parts 152 and 151. The forked extensions 160 and 162 of the male part 152 embrace the release button 153 within the female part 151 whenever the buckle 150 is engaged.

The release button 153 is located on cantilevered release button carrier 155 of the female part 151. The female part 151, as seen in end view FIGS. 30 and 33, includes side walls 157 and 159 which engage the prongs 154 and 156, respectively, in a similar manner as the bosses 32 and 34 of the male member 11 of FIGS. 1–7. In this embodiment, the release button carrier 155 and the release button 153 remain protected within the female member 151 whether the buckle 150 is latched or unlatched.

For an understanding of the operation of this third alternate embodiment, reference is now made to FIG. 33 which shows a prong 154 in its buckle-releasing position as the release button 153 and its carrier 155 have moved downward under finger pressure in the direction of the arrow so that the boss 154B has cleared the side wall 159 of the cantilevered carrier 155. As the buckle separates, the prongs 154 and 156 are removed, and the finger or thumb pressure on the button is released, the plastic memory of the cantilevered carrier 155 returns it to its normal position within the female part 151. To facilitate re-engagement, the walls 157 and 159 may be tapered to allow the prongs 154 and 156 to resume their normal locking position shown in FIG. 33 by the dashed line.

Fourth Alternate Embodiment

During a later stage of the development of this invention, it appeared that the first embodiment described above could be further improved by providing an even more positive means of preventing unlocking of the buckle without depressing the center cantilevered tongue first. As discussed above, it is possible for an inadvertent downward pressure to be exerted against the top prong and an upward pressure on the lower prong. An unexpected contact with the button at that time could then release the buckle. This improved embodiment is described in connection with FIGS. 37 and 38.

Figure 37:
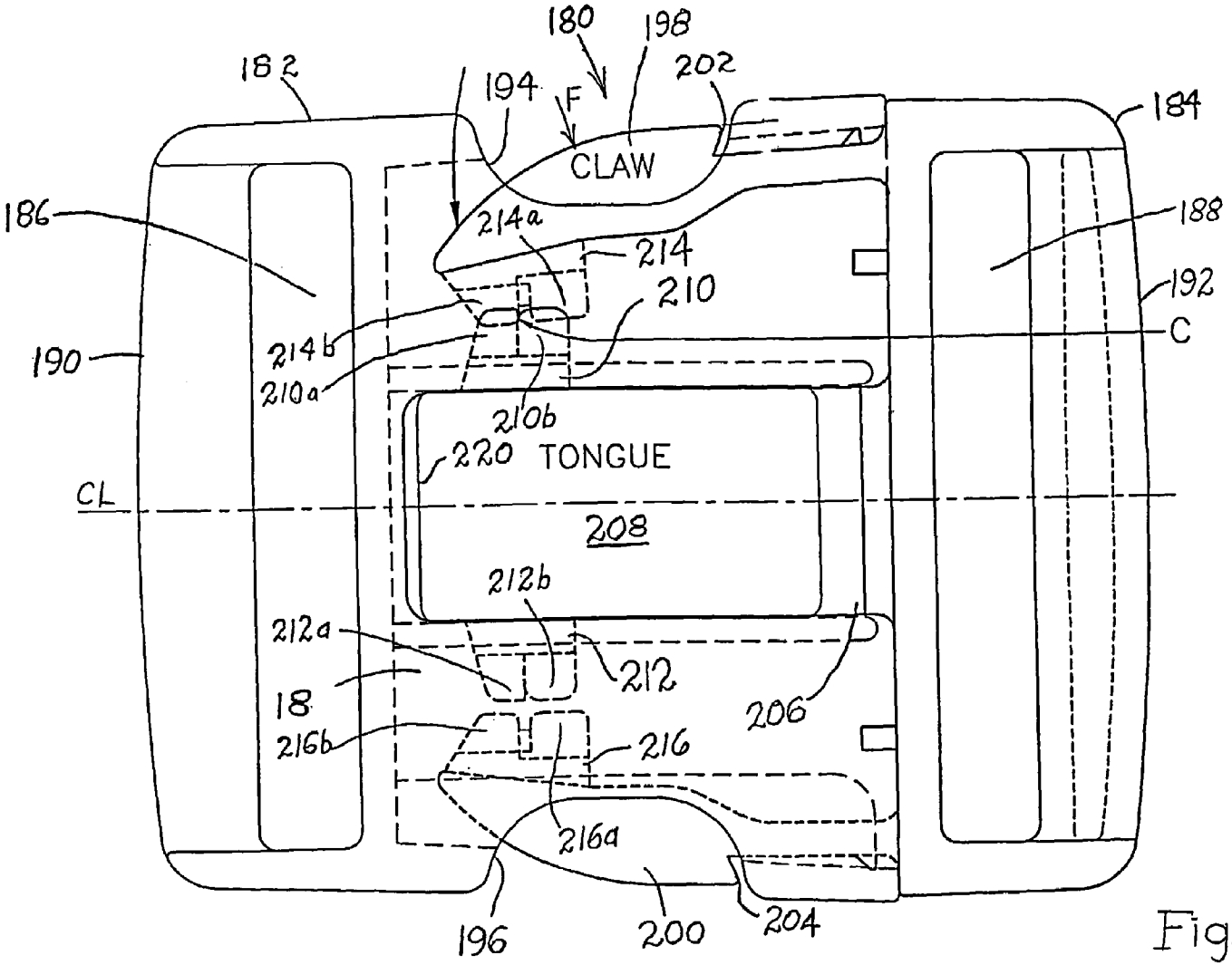
FIG. 37 is a front elevational view of the buckle according to the fourth alternate embodiment of the invention with interlocking prong and tongue surfaces.

FIG. 37 is a composite front view of a two-part buckle in which the portions above and below the center line show certain parts in alternate positions, as described below.

FIG. 37 shows the front face of a buckle generally designated 180 that includes a partially hollow female member 182 and a male member 184 in assembled condition with respective belt loops 186 and 188 defined by cross bars 190 and 192, respectively. The male and female parts 182 and 184, respectively, are shown locked together with the female part having a front face 185 and recesses 194 and 196 in the upper and lower edges, respectively, and the male member 184 with upper and lower flexible prongs 198 and 200 which extend through openings defined by recesses 194 and 196 of the female member 182 and in locking engagement with catches 202 and 204. Female member 182 is, or may be, identical to female member 11 of FIGS. 1 and 2.

The male member 184 has a three-part extension including the two prongs 198 and 200, and a cantilevered resilient tongue 206 carrying a release button 208 and integral stop members 210 and 212. Prongs 198 and 200 include bosses 214 and 216, respectively, which engage the stop members 210 and 212.

Each half of buckle 180 is symmetrical above and below center line CL. That portion of FIG. 37 below center line CL shows prong 200 in the position which both prongs 198 and 200 occupy when the two parts of buckle 180 are latched together and there is no effort to separate them. Stop member 212 and boss 216 are slightly separated but are aligned with respect to the plane of the paper. With no effort to separate buckle parts 182 and 184, boss 214 and stop 210 would be separated as boss 216 and stop 212 are shown.

Above the center line CL, prong 198 is shown forced inwardly by means of a force F whose direction is indicated by the arrow. This force would normally be imposed by a wearer's thumb if the top of the drawing is viewed as up. At the same time, prong 200 would also be subjected to an inwardly directed force from the middle finger of the wearer. Unless button 208 is depressed, the interfitting of tapered or beveled edges 214*a* and 214*b* of boss 214 will become interleaved with tapered or beveled edges 210*a* and 210*b* of stop 210 and in actual contact as shown by tapered edge 210*a* overlying tapered edge 214*b* as indicated by the arrow labeled C.

At the same time tapered edges 216*a* and 216*b* of boss 216 similarly become interleaved and in locking engagement with tapered edges 212*a* and 212*b* of stop 212. With these parts interleaved, as described, button 208 cannot be depressed and the buckle parts 182 and 184 will not separate.

Details of this interaction between button 208 and prongs 198 and 200 may become easier to follow by consideration of perspective drawing FIG. 38. In this drawing, only prong 198 and button 208 are shown, prong 200 operating identically to prong 198.

Stop member 210 and boss 214 are each formed with upward and downward sloping tapered edges 210*a* and 210*b* and upward and downward sloping tapered edges 214*a* and 214*b*, respectively. Cantilevered tongue 206 also includes a stop 212 that includes a downward sloping tapered edge 212*a* and an upward sloping tapered edge 212*b*. Boss 216 of prong 200 (FIG. 37) also includes an upward sloping tapered edge 216*b* and a downwardly sloping tapered edge 216*a*. It will be recognized that "upwardly" and "downwardly" are in relation to the parts shown in FIG. 38.

As the male member 184, including prongs 198 and 200 and tongue 206, is inserted into female member 182, prongs 198 and 200 are progressively bent inwardly. At the same time, tongue 206 is depressed downwardly or behind the front face of female member 182 until it reaches an opening 220 (FIG. 37) when button 208 snaps into opening 220.

A slight further movement of male member 184 causes catches 202 and 204 to snap over the mating recess edges 194 and 196 of female member 182 releasing the inward pressure on prongs 198 and 200 and permitting them to move outwardly carrying the tapered edges of bosses 214 and 216 away from stops 210 and 212. These bosses remain aligned with stops 210 and 212 and only a very small distance away so that any inward pressure on either of prongs 198 or 200 will cause tapered edges of bosses 214 and 216 to contact tapered edges of stops 210 and 212, preventing further inward movement of the prongs and release of the buckle.

To release the buckle, button 208 must be pushed downwardly, so that stops 210 and 212 and their respective tapered edges are out of alignment below bosses 214 and 216. Then, inward pressure will move prongs 198 and 200 sufficiently far so that catches 202 and 204 will clear their mating recesses on female member 182 permitting male member 184 to be withdrawn from female member 182.

It will be appreciated that it would not always be necessary to include all of the above edge surfaces to enjoy the benefits of the above described fourth alternate embodiment. FIG. 39 shows a modification of the structure of FIG. 38 wherein stop 210' comprises a V-shaped edge on the side of the button 208'. Boss 214' is an extension of prong 198' having an internal V-shaped groove which is complementary or mating with respect to the V-shaped edge on stop 210'. Inward pressure on prong 198' will cause boss 214' to enter and latch with stop 210, preventing button 210 from moving out of alignment with the prongs and release of the male and female buckle parts.

Boss 216 and stop 212 could be similarly modified and either one or both pairs of boss and stops may be used. Also, the V-shaped edges could be formed on prongs 198 and 200 and the V-shaped groove on button 208 and 210.

Fifth Alternate Embodiment

Experience with the fourth alternate embodiment described above disclosed that in some configurations it was possible, particularly with a very vigorous squeeze on the prongs, for the tapered edges of the prongs and the stops to wedge or bind together, preventing the tongue 206 and button 208 from being moved out of the way of the prongs. Applicant has essentially eliminated this problem by incorporating a limit surface or small abutment on the surface of each of bosses 214*a* and 216*a* (FIG. 3) which limits the inward travel of prongs 198 and 200, thereby preventing the wedging action referred to above.

Figure 40:
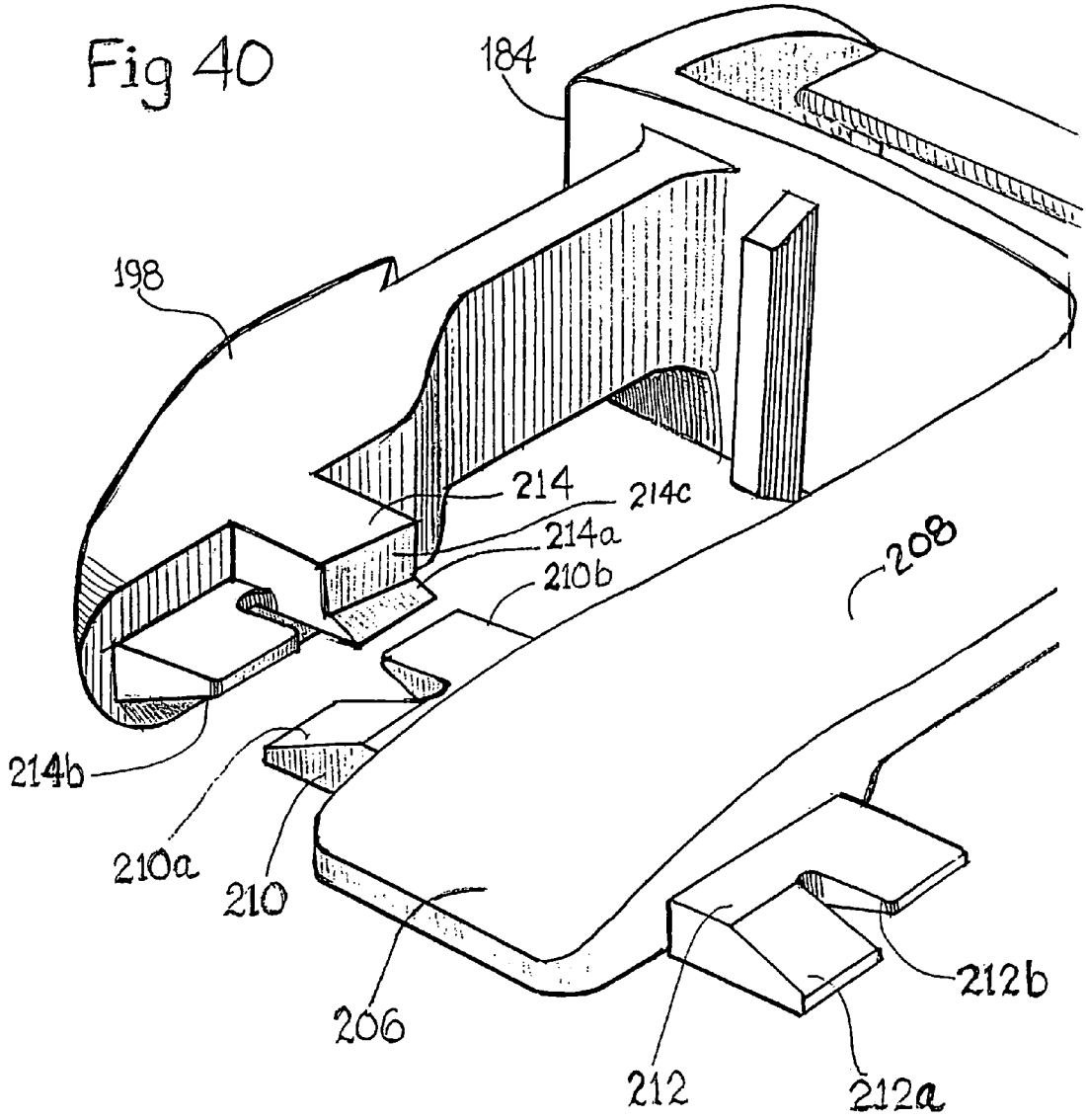
FIG. 40 is a fragmentary perspective view of a modified form of the fourth embodiment shown in FIGS. 37 and 38.

This structure is shown on FIG. 40, which is very similar to FIG. 38, and in which corresponding parts have been given the same numerals. As in the case of FIG. 38, the prong 200, with boss 216, does not appear in this perspective view since it is a mirror image of prong 198 and boss 214. It will be observed that boss 214, which carries tapered edges 214*a* and 216*a* includes a limit surface or abutment 214*c* positioned to limit the extent of overlap of tapered edge 210*b* with tapered edge 214*a*. Boss 216 preferably includes a similar abutment which limits the travel of tapered edge 212*b*. It will be recognized that the limit surface or abutment described could also be placed on any of bosses 214 or 216 or on stop 210 or 212 so long as it is positioned to avoid the wedging action described above.

The fourth and fifth alternate constructions are also applicable to the third alternate embodiment described above.

SUMMARY

In each of these embodiments, the buckle parts are preferably fabricated by molding out of such a material as nylon or Delrin of the Dupont Engineering Polymers of Wilmington, Del. In each case, the buckle employs two catches on opposite edges of the buckle which are releasable by inwardly applied manual pressure. The embodiments also include an auxiliary stop or lobe which engages each of these catches to prevent them from releasing unless the auxiliary stop or lobe is moved aside to allow the catches to move in a releasing direction. The auxiliary stop or lobes are controlled by a resiliently mounted release button, as in the first described embodiment, the third and fourth alternative embodiments or by a sliding or rotating locking device, as in the first and second alternative embodiments, respectively. Each of these variants upon this invention are effective to add a greater degree of security to buckles for a variety of uses.

The foregoing embodiments are merely representative of the principles of this invention and are not to be considered as limiting. It is apparent that one, given the teaching present could produce buckles which incorporate the principles of this invention while still having some difference. Therefore, the scope of this invention is not to be considered limited to the embodiments shown but, instead, are defined by the following claims including the scope afforded by the Doctrine of Equivalents.

I claim:

1. In a buckle including an auxiliary locking feature:

a female buckle part including belt or strap receiving portion, and a body portion defining a recess for receiving a mating portion of a male buckle part;

a male buckle part including a belt or strap receiving portion and a female buckle engaging part;

the body portion of said female buckle part including a pair of edge recesses;

the female buckle engaging part of said male buckle part including a pair of flexible prongs for insertion into the recess of said female buckle part and for engaging said female buckle part to secure the buckle parts together;

said prongs being accessible through said edge recesses for manually releasing said prongs to allow said male and female parts to separate;

a manually controlled member integral with said male buckle part engaging the prongs of said male buckle part for selectively preventing the flexing of said prongs and release of said buckle parts; and wherein the improvement comprises:

at least one tapered surface on one of said manually controlled member and said prongs; and a pair of tapered surfaces on another of said manually controlled member and said prongs aligned with said at least one tapered surface;

such that movement of said prongs in a disengaging direction places said at least one tapered surface in engagement with said pair of tapered surfaces preventing release of said male and female parts; and wherein said manually controlled member is movable perpendicularly with respect to the plane of movement of said prongs to permit flexing of said prongs and release of such buckle parts.

2. A buckle as claimed in claim 1 wherein said prongs and said manually controlled member each include oppositely directed tapered edge surfaces, tapered edge surfaces of said prongs being aligned to interleave with and contact tapered edge surfaces of said manually controlled member for preventing said prongs from releasing said male and female parts.

3. A buckle in accordance with claim 2 wherein said manually controlled member comprises a button depressible with respect to said buckle parts to move tapered edge surfaces of said manually controlled member out of alignment with tapered edge surfaces of said prongs.

4. A buckle as claimed in claim 1 wherein said tapered surfaces are located on both of said prongs and said manually controlled member.

5. A buckle in accordance with claim 1 wherein at least one tapered surface on one of said prongs and said manually controlled member includes a limit surface positioned to prevent said tapered surfaces from becoming wedged together.

6. In a buckle including an auxiliary locking feature:

a female buckle part including belt or strap receiving portion, and a body portion defining a recess for receiving a mating portion of a male buckle part;

a male buckle part including a belt or strap receiving portion and a female buckle engaging part;

the body portion of said female buckle part including a pair of edge recesses;

the female buckle engaging nart of said male buckle part including a pair of flexible prongs for insertion into the recess of said female buckle part and for engaging said female buckle part to secure the buckle parts together;

said prongs being accessible through said edge recesses for manually releasing said prongs to allow said male and female buckles to separate;

a manually controlled member engaging the prongs of said male buckle part for selectively preventing the flexing of said prongs and release of said buckle parts; and wherein the improvement comprises:

at least one tapered surface on one of said manually controlled member and said prongs;

a pair of tapered surfaces on another of said manually controlled member and said prongs aligned with said at least one tapered surface;

such that movement of said prongs in a disengaging direction places said at least one tapered surface in enaagement with said pair of tapered surfaces preventing release of said male and female parts;

wherein said manually controlled member comprises a manually operated button and includes resilient means carrying said button;

such that said manually controlled member releases said prongs upon operation of said button.

7. A buckle in accordance with claim 6 wherein said female part includes a front face having an aperture therein and said button is accessible through said aperture.

8. A buckle in accordance with claim 6 wherein said manually controlled member is a cantilevered tongue formed integrally with a buckle part and is located within the recess of said female part when said buckle is engaged.

9. A buckle in accordance with claim 8 wherein said cantilevered tongue is formed integrally with said male buckle part.

10. A buckle in accordance with claim 8 wherein said button is operational to deflect said cantilevered tongue away from said prongs to allow said prongs to flex and to release the buckle parts.

11. A buckle in accordance with claim 10 wherein said cantilevered tongue comprises a button depressible to move an edge surface of said tongue out of engagement with an edge surface of said prong.

12. A buckle in accordance with claim 8 wherein said cantilevered tongue is mounted for movement with respect to said prongs to move from a first prong locking position to a second prong unlocking position in response to manual action of the user.

13. A buckle as claimed in claim 8 wherein each of said prongs includes upwardly and downwardly tapered surfaces and said tongue has two sides, both of which include upwardly and downwardly tapered surfaces generally aligned with said upwardly and downwardly tapered surfaces of said prongs.

14. A buckle as claimed in claim 13 wherein movement of said prongs in a disengaging direction causes tapered surfaces of said prongs to engage tapered surfaces of said tongue, placing said prongs and said tongue in engagement and preventing release of said male and female parts.

15. A buckle in accordance with claim 6 wherein said male part includes said cantilevered member located between said prongs and carrying said button.

16. A plastic buckle comprising:

a female part including a belt attachment loop at one edge and a male part receiving opening at the opposite end from said belt attachment loop;

said female part having a front face, a rear face and a pair of edges;

said female part defining a pair of recesses, one in each of said edges, communicating with said male part receiving opening;

a male part including a belt attachment loop at one edge and a pair of prongs at the opposite edge dimensioned to enter said male part receiving opening in said female part and for engaging said recesses to secure said male and female parts together and to flex under finger pressure to release said male and female parts;

said male part further including an integral manually controlled member, at least one tapered surface on one of said prongs and said manually controlled member which is aligned with other tapered surfaces on another of said prongs and said manually controlled member, such that movement of said prongs in a disengaging direction places said tapered surfaces in engagement preventing release of said male and female parts; and said manually controlled member being movable perendicularly with respect to the plane of movement of said nrongs to move the tapered surfaces of said manually controlled member out of alignment with tapered surfaces of said prongs such that said prongs are movable to release said male and female parts.

17. A plastic buckle comprising:

a female part including a belt attachment loop at one edge and a male part receiving opening at the opposite end from said belt attachment loop;

said female part having a front face, a rear face and a pair of edges;

said female part defining a pair of recesses, one in each of said edges, communicating with said male part receiving opening;

a male part including a belt attachment loop at one edge and a pair of prongs at the opposite edge dimensioned to enter said male part receiving opening in said female part and for engaging said recesses to secure said male and female parts together and to flex under finger pressure to release said male and female parts;

said buckle further including a manually controlled member, at least one tapered surface on one of said prongs and said manually controlled member which is aligned with other tapered surfaces on another of said prongs and said manually controlled member, such that movement of said prongs in a disengaging direction places said tapered surfaces in engagement preventing release of said male and female parts; and said manually controlled member being operable to move the tapered surfaces of said manually controlled member out of alignment with tapered surfaces of said prongs such that said prongs are movable to release said male and female parts; and wherein said manually controlled member is a cantilevered tongue formed integrally with a buckle part and is located within the recess of said female part when said buckle is engaged.

18. A buckle as claimed in claim 17 wherein said prongs and said cantilevered tongue each include upwardly and downwardly directed tapered surfaces, tapered surfaces of said tongue being aligned to interleave with and contact tapered surfaces of said prongs for preventing said prongs from releasing said male and female parts.

19. A buckle in accordance with claim 17 wherein said cantilevered tongue is formed integrally with said male buckle part.

20. A buckle in accordance with claim 17 wherein at least one tapered surface on one of said prongs and said cantilevered tongue includes an abutment positioned to prevent said tapered surfaces from becoming wedged together.

21. A plastic buckle comprising:

a female part including a belt attachment loop at one edge and a male part receiving opening at the opposite end from said belt attachment loop;

said female part having a front face, a rear face and a pair of edges;

said female part defining a pair of recesses, one in each of said edges, communicating with said male part receiving opening;

a male part including a belt attachment loop at one edge and a pair of prongs at the opposite edge dimensioned to enter said male part receiving opening in said female part and for engaging said recesses to secure said male and female parts together and to flex under finger pressure to release said male and female parts;

said buckle further including a manually controlled member, at least one tapered surface on one of said prongs and said manually controlled member which is aligned with other tapered surfaces on another of said prongs and said manually controlled member, such that movement of said prongs in a disengaging direction places said tapered surfaces in engagement preventing release of said male and female parts; and said manually controlled member being operable to move the tapered surfaces of said manually controlled member out of alignment with tapered surfaces of said prongs such that said prongs are movable to release said male and female parts;

wherein said manually controlled member comprises a manually operated button and includes resilient means carrying said button.

22. In a buckle including an auxiliary locking feature including:

a female buckle part including a belt or strap receiving portion, and a body portion defining a recess for receiving a mating portion of a male buckle part and a pair of edge recesses;

a male buckle part including a belt or strap receiving portion and a female buckle engaging part;

the female buckle engaging part including a pair of flexible prongs for insertion into the recess of said female part and for engaging edge recesses of said female part to secure the buckle parts together, said prongs being accessible through said edge recesses for manually releasing said prongs to allow said male and female buckles to separate; and a manually controlled tongue integral with said male buckle engaging the prongs of said male buckle part for selectively preventing the flexing of said prongs and release of said buckle parts;

characterized in that said prongs each include upwardly and downwardly directed tapered surfaces, said tongue includes upwardly and downwardly directed tapered surfaces aligned to interleave with the tapered surfaces of said prongs such that in the absence of manual operation of said tongue, forces acting on said prongs in a releasing direction cause tapered surfaces on said prongs to engage tapered surfaces on said tonaue and prevent release of said buckle parts;

whereby manual operation of said tongue perpendicularly with respect to the piane of movement of said prongs forces the tapered surfaces of said tonque out of alignment with tapered surfaces of said prongs and permits flexing of said prongs to disengage said female part.

* * * * *